US007678027B2

(12) United States Patent
Sanghavi

(10) Patent No.: US 7,678,027 B2
(45) Date of Patent: Mar. 16, 2010

(54) BALL EXERCISER FOR ARMS AND TORSO

(75) Inventor: Maulik Sanghavi, 55 Rambling Dr., Scotch Plains, NJ (US) 07076-2957

(73) Assignee: Maulik Sanghavi, Scotch Plains, NJ (US)

( * ) Notice: Subject to any disclaimer, the term of this patent is extended or adjusted under 35 U.S.C. 154(b) by 281 days.

(21) Appl. No.: 11/811,232

(22) Filed: Jun. 8, 2007

(65) Prior Publication Data

US 2008/0305935 A1 Dec. 11, 2008

(51) Int. Cl.
*A63B 21/00* (2006.01)

(52) U.S. Cl. ..... 482/76; 482/75; 601/131

(58) Field of Classification Search ..... 601/131; 482/75, 76

See application file for complete search history.

(56) References Cited

U.S. PATENT DOCUMENTS 4,132,404 A * 1/1979 Wilson ..... 482/132
4,892,305 A * 1/1990 Lynch ..... 482/132
6,093,159 A * 7/2000 Racoosin ..... 601/131

* cited by examiner

*Primary Examiner*—Jerome W. Donnelly
(74) *Attorney, Agent, or Firm*—Ezra Sutton

(57) ABSTRACT

An exercise ball device for exercising by a user while in a prone position. The exercise ball device includes a semi-circular shaped housing having an outer curved surface and an interior curved compartment having an inner curved surface. The housing has a retaining member positioned on the perimeter edge of the housing. The exercise ball device also includes a rolling ball positioned within the interior curved compartment, and the rolling ball is removably restrained within the interior curved compartment by the retaining member. Further, the outer curved surface of the housing has a restraint member attached thereto for receiving the hand of a user. Additionally, the rolling ball is approximately the same size as the interior curved compartment so that the rolling ball rotates or rolls within and relative to the housing.

14 Claims, 7 Drawing Sheets

BALL EXERCISER FOR ARMS AND TORSO

FIELD OF THE INVENTION

The present invention relates to an exercise ball device for exercising by a user while in a bent over prone position. More particularly, the exercise ball device includes a semicircular-shaped housing having a free and movable rolling ball inside the housing. Further, the exercise ball device includes a grasping sleeve or handle strap attached to an outer curved surface of the semicircular-shaped housing for holding the exercise ball device when in an operational mode.

BACKGROUND OF THE INVENTION

Exercise ball devices where a user applies his or her own weight and strength for exercising are well-known in the art having many variations. These types of ball devices are used mainly for the development of the user's torso, stomach and the like. Other types of ball devices are used as balancing exercise devices, wherein the board rests on or against the ball and the person then positions a body part on the board. Many of these aforementioned exercise ball devices are not easy to use and do not provide good exercise results.

There remains a need for a new and improved exercise ball device that is simple to operate and exercise with when the user is in a bent over prone position. Additionally, the exercise ball device is uncomplicated in structure and easily used and operated by the user during his or her workout.

DESCRIPTION OF THE PRIOR ART

Exercise ball devices, physical workout balls, upper torso exercisers, balancing and exercise devices, flexible hemispherical exercise devices and the like, having various designs, configurations, structures and materials of construction have been disclosed in the prior art. For example, U.S. Pat. No. 6,773,379 to BING discloses an exercise device for the upper torso of a user that includes a base, a plurality of wheel assemblies, and a handle assembly. The base is equilateral triangular-shaped and has an uppermost surface and a lowermost surface. The handle assembly is swivelly-positioned in the uppermost surface of the base so as to allow the handle assembly to achieve a desired hand position relative to the plurality of wheel assemblies. The three wheel assemblies in combination with the base being equilateral triangular-shaped, prevent rocking. Each wheel assembly is rotatably mounted in the lowermost surface of the base. This prior art patent does not disclose or teach the design, structure and configuration of the exercise ball device of the present invention.

U.S. Pat. No. 6,652,421 to CHEN discloses a physical workout ball including a ball with a strap. The ball is in a hollow sphere shape made of rubber, plastic and other soft materials with a through hole in the center, and an injecting hole located on the surface of the ball to inject air or iron sand in. The straps are in a strip shape made of cloth with Velcro™ on both ends and pass through the hole of the ball. This invention offers different workout and exercise methods for different body muscles. This prior art patent does not disclose or teach the design, structure and configuration of the exercise ball device of the present invention.

U.S. Pat. No. 6,551,225 to ROMERO discloses a balancing exercise device for an individual having a flexible hemisphere having a flat circular surface and a hemispherical side surface and being made out of flexible resilient material which will compress when placed under pressure, and a pair of attachment straps respectively affixed on oppositely disposed sides of the hemispherical side surface and which are connected by connecting members respectively located on each attachment strap so that a body part is held against said flat circular surface when the attachment straps are connected. This prior art patent does not disclose or teach the design, structure and configuration of the exercise ball device of the present invention.

U.S. Pat. No. 5,735,776 to SWEZEY et al. discloses a versatile bidirectional isometric exercise device in the form of an inflatable flexible exercise ball that is about 18 inches in diameter. A pair of looped handles are secured to diametrically opposite points of the ball, through which arms or legs can be placed for performing specialized exercises that use the ball in a tension mode. The ball is only partially inflated so as to provide soft compliant accommodation to various body surfaces and can be utilized bidirectionally, ie either in compression or in tension, in conjunction with various body parts such as hands, legs, knees, feet, etc. It can be used for a broad array of isometric muscle exercises directed to overall body strengthening, particularly for persons prone to and/or desiring protection from the effects of osteoporosis. This prior art patent does not disclose or teach the design, structure and configuration of the exercise ball device of the present invention.

U.S. Pat. No. 5,632,707 to DANIEL et al. discloses a device for exercising a user's torso that utilizes a minimum of space. A wheeled housing is provided with a handle member providing an effective grip to a user who will lean his or her body's weight against the device is coupled to one or more of the wheels to display the amount of rotation of the wheels thereby giving an indication to a user of the amount of exercise undertaken. A reader of the movement of the device has an out put connected to a counter/display that is resettable. The reader is mounted in a spring-loaded cavity so that an effective outwardly force brings its ball member in contact with the surface. This prior art patent does not disclose or teach the design, structure and configuration of the exercise ball device of the present invention.

None of the aforementioned prior art patents teach or disclose the design, configuration and structure of an exercise ball device having a semicircular-shaped housing containing a free moving rolling ball within an interior curved compartment of the housing and having a gripping/grasping member attached to an outer curved surface for gripping the exercise ball device by a user for exercising.

Accordingly, it is an object of the present invention to provide an improved exercise ball device that is simple and easy to operate and exercise with when the user is in a bent over prone position.

Another object of the present invention to provide an improved exercise ball device having a semicircular-shaped housing or an outer hemispherical housing with a free moving rolling ball within an interior hemispherical or curved compartment of the hemispherical housing.

Another object of the present invention to provide an improved exercise ball device having a restraint member attached to an outer curved surface of the hemispherical housing for holding the exercise ball device when in an operational mode, wherein the restraint member can be in the form of a grasping sleeve, a Velcro™ holding strap, a gripping handle, other gripping restraints and the like.

Another object of the present invention to provide an improved exercise ball device having a restraint member in conjunction with a hand impression member positioned also on the outer curved surface of the semicircular housing for allowing the user a better and stronger grip on the exercise ball device when the user's hands are secured by the restraint members.

Another object of the present invention to provide an improved exercise ball device where the roller ball in the interior curved compartment of the outer semicircular housing is removable and replaceable and the rolling ball is refillable by air or is in a solid form such as a hard plastic, rubber and the like.

Another object of the present invention to provide an improved exercise ball device that includes inner anti-friction sections or strips attached to an inner curved surface of the interior curved compartment of the semicircular housing permitting the rolling ball to roll freely in any direction within the interior curved compartment.

Another object of the present invention to provide an improved exercise ball device that is compact in size for easy storage, lightweight for maneuverability, uncomplicated in structure and easily used and operated by the user during his or her workout.

A further object of the present invention to provide an improved exercise ball device that can be mass-produced in an automated and economical manner and is readily affordable by the consumer.

SUMMARY OF THE INVENTION

In accordance with the present invention, there is provided an exercise ball device for exercising by a user while in a prone position. The exercise ball device includes a semicircular shaped housing having an outer curved surface and an interior curved compartment having an inner curved surface. The housing has a retaining member positioned on the perimeter edge of the housing. The exercise ball device also includes a rolling ball positioned within the interior curved compartment, and the ball is removably restrained within the interior curved compartment by the retaining member. Further, the outer curved surface of the housing has a restraint member attached thereto for receiving the hand of a user. Additionally, the rolling ball is approximately the same size as the interior curved compartment so that the ball rotates or rolls within and relative to the housing.

BRIEF DESCRIPTION OF THE DRAWINGS

Further objects, features and advantages of the present invention will become apparent upon the consideration of the following detailed description of the presently preferred embodiment when taken in conjunction with the accompanying drawings, wherein.

DETAILED DESCRIPTION OF THE PREFERRED EMBODIMENT 10

Figure 4:
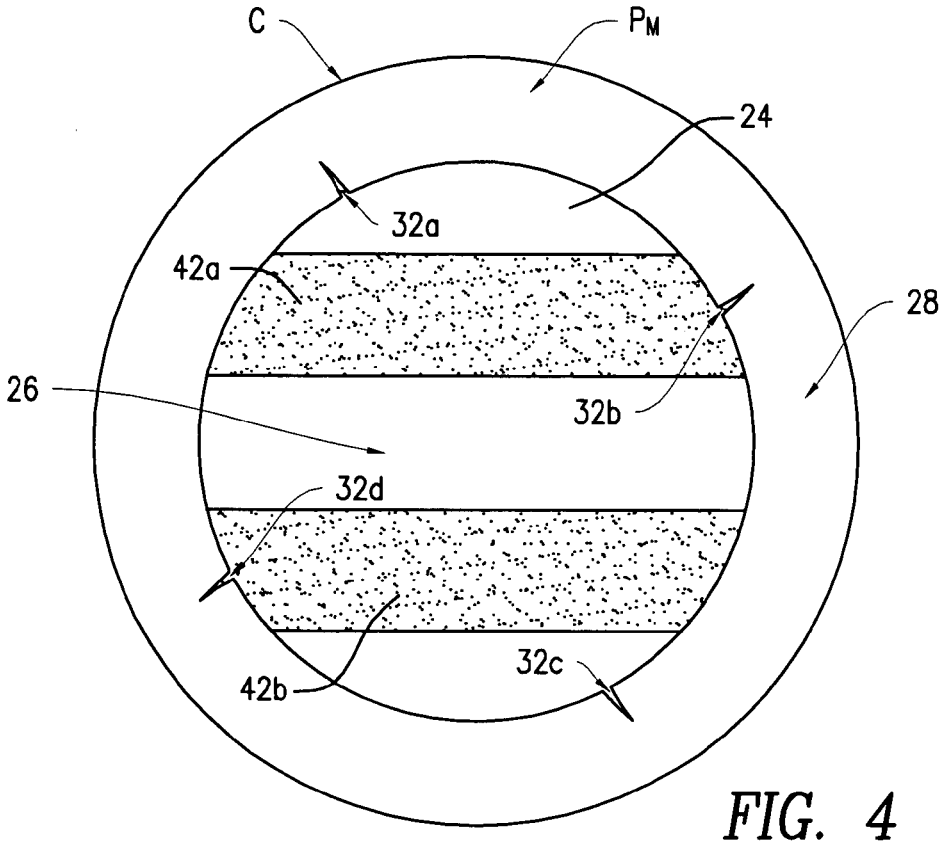
FIG. 4 is a bottom plan view of the exercise ball device of the present invention showing an interior compartment of the semicircular housing having a pair of inner anti-friction strips attached to an inner curved surface of the interior curved compartment.
Figure 5:
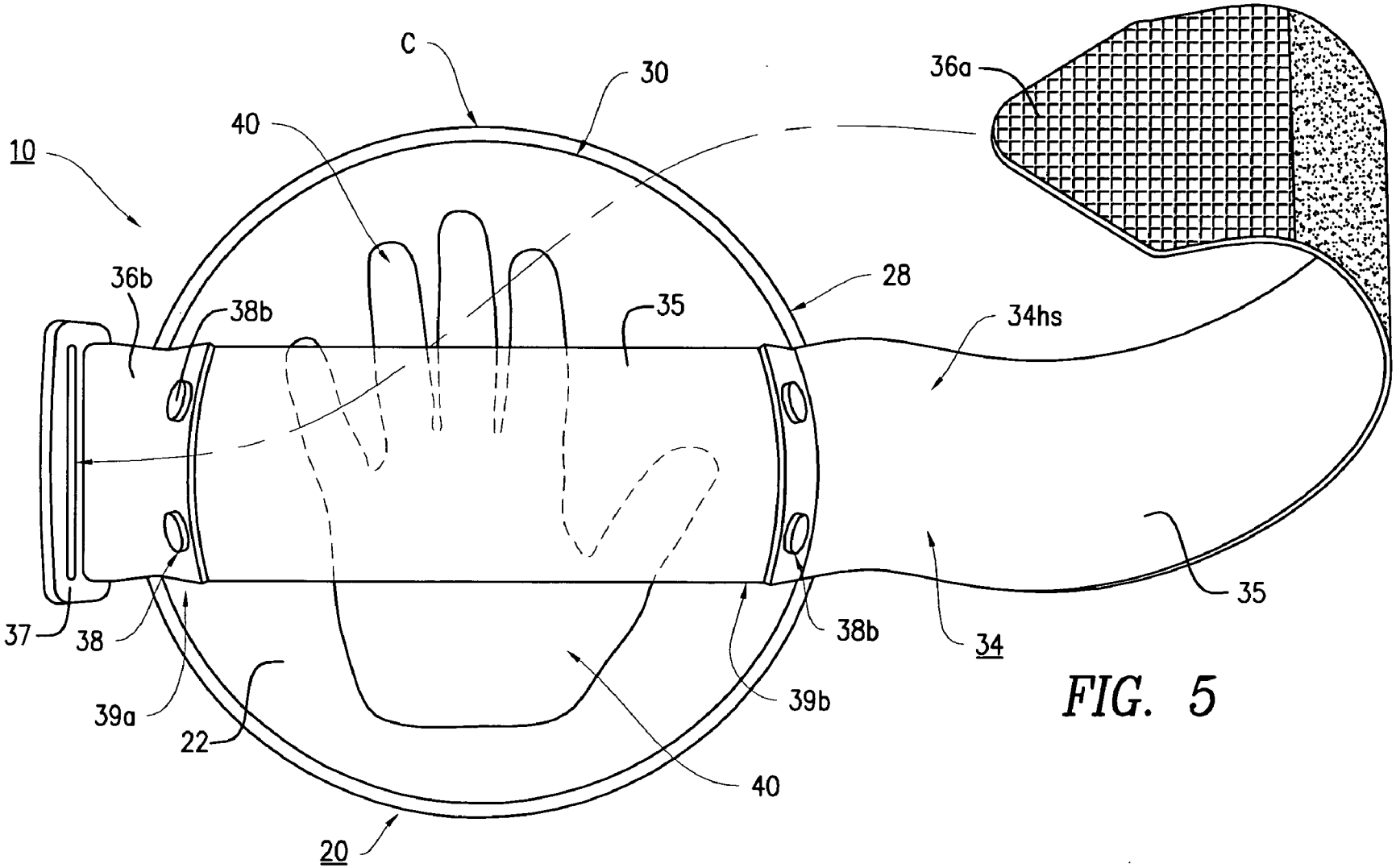
FIG. 5 is a top plan view of the exercise ball device of the present invention showing a gripping member attached to an outer curved surface of the semicircular housing and a hand impression member on the outer curved surface of the semicircular housing.
Figure 6:
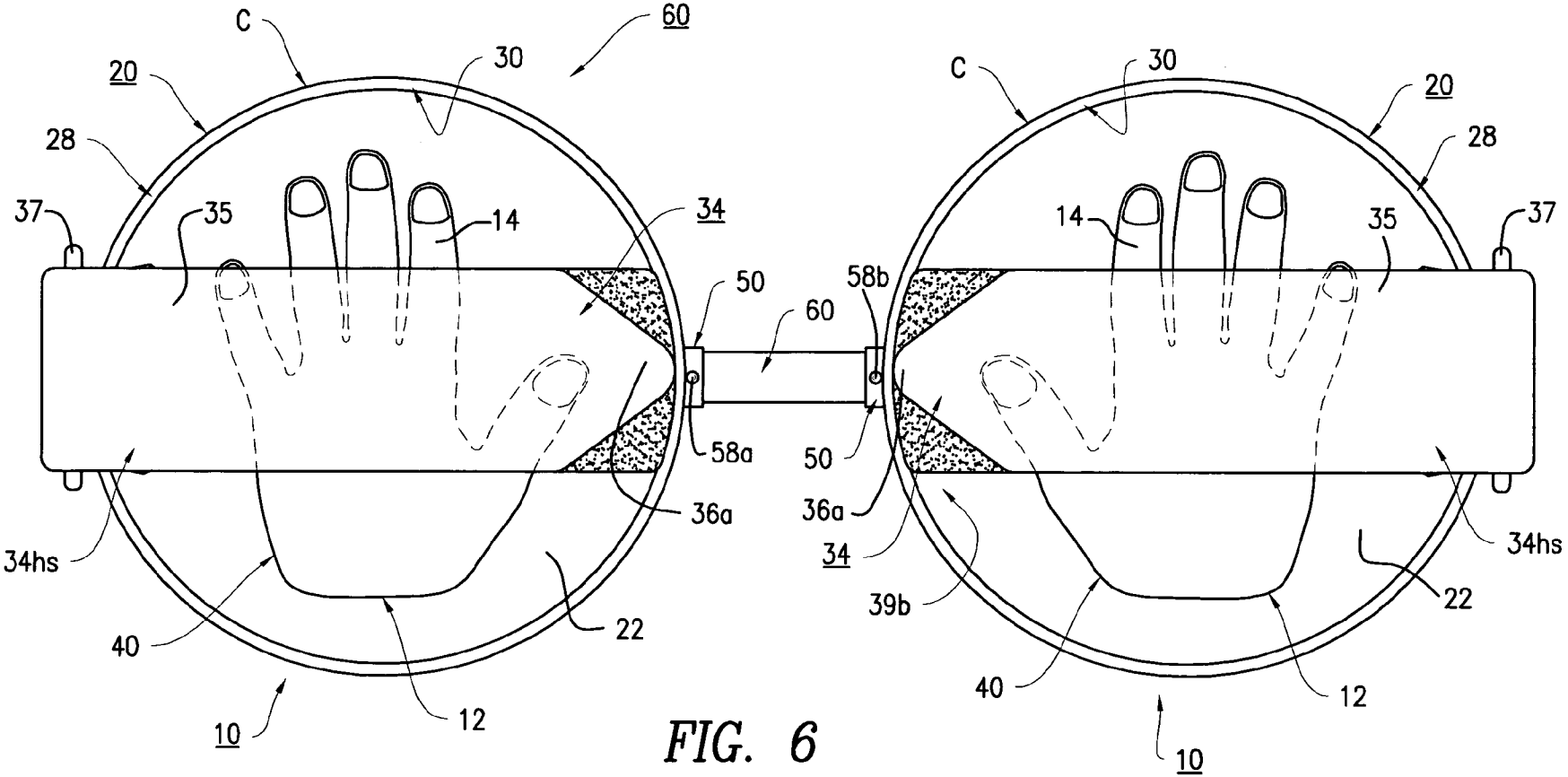
FIG. 6 is a top plan view of the exercise ball device of the present invention showing the two semicircular housings attached with each other by a detachable connecting bar member.

The improved exercise ball device 10 and its component parts of the preferred embodiment of the present invention is represented in detail by FIGS. 1 through 7 of the patent drawings. The exercise ball device 10 is used for exercising by a user 12 when in a bent over prone position (not shown), using a single exercise ball device 10 or using two exercise ball devices 10 and 10' being connected together, as shown in FIG. 6.

As shown in FIGS. 1 through 10, the exercise ball device 10 includes semicircular-shaped housing or an outer semicircular housing 20. The semicircular housing 20 includes an outer curved surface 22 and an inner curved surface 24. The semicircular housing 20 also includes an interior semicircular or curved compartment 26 for removably receiving a rolling ball 40 within the interior curved compartment 26. In addition, the semicircular housing 20 also includes a retaining ring member 28 positioned on a perimeter edge 30 along the circumference C of housing 20. The retaining ring member 28 includes a plurality of equally spaced-apart cutouts of retaining sections 32*a*, 32*b*, 32*c* and 32*d*, respectively, for ease of receiving or removing the ball 40 from the interior semicircular compartment 26 of housing 20. The retaining ring member 28 is made from soft, flexible and pliable materials $P_M$ selected from the group consisting of neoprene polyester, styrofoam, rubber, nylon, teflon and combinations thereof.

Figure 1:
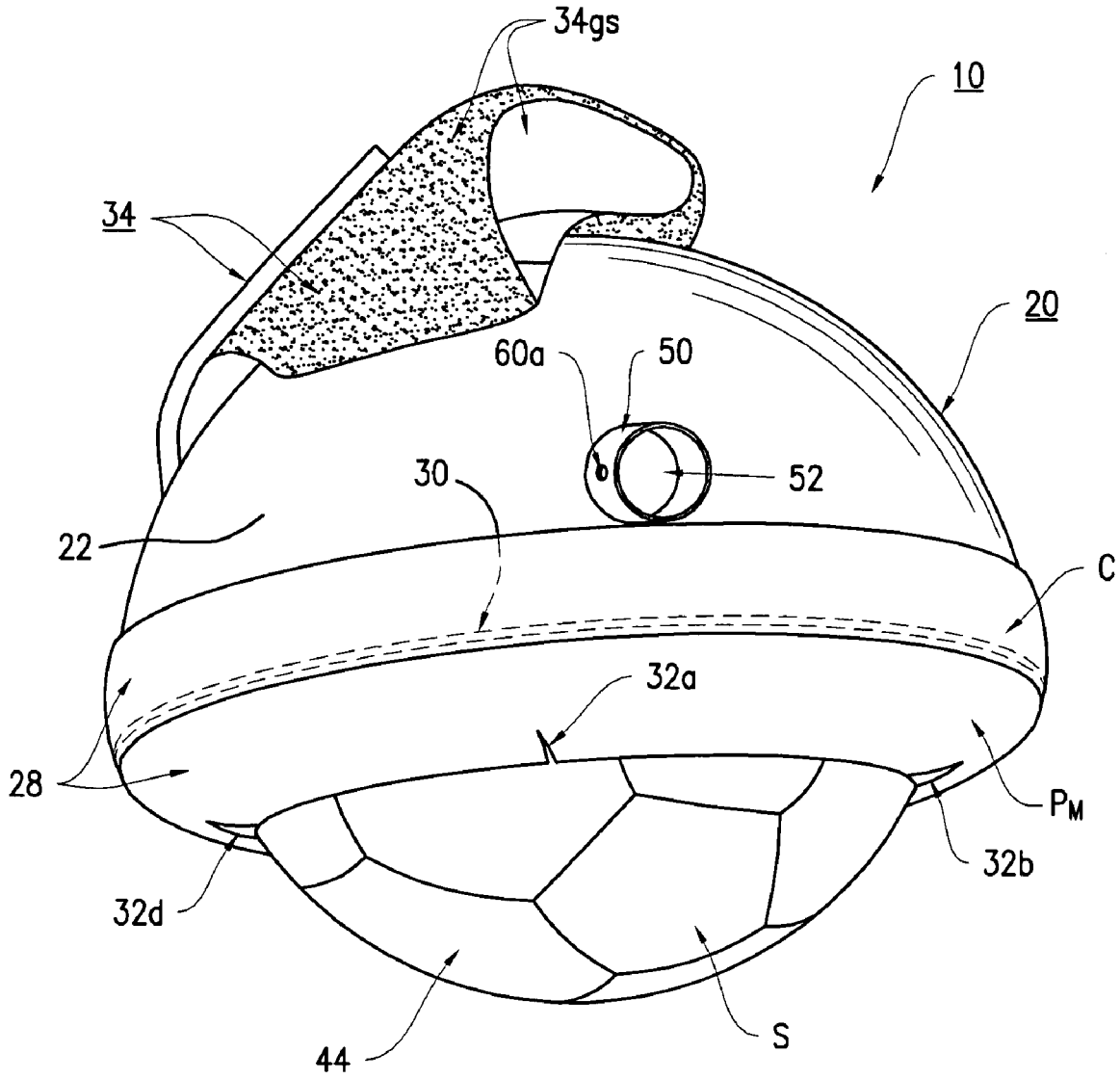
FIG. 1 is a perspective view of the exercise ball device of the preferred embodiment of the present invention showing the major component parts thereto and in an assembled state being readied for operational use.

The outer curved surface 22, as shown in FIGS. 1, 5 and 6, includes a centrally positioned restraint member 34 attached thereto for receiving a hand 14 of the user 12. The gripping member 34 in the form of a hook and loop holding strap 34*hs* as depicted in FIG. 5, includes a hook and loop strap section 35 having a first end 36*a* and a second end 36*b*, a loop member 37 for looping the hook and loop strap section 35 upon itself. The strap section 35 includes opposing attachment elements 38 in the form of bolts 30*b* connected to the outer curved surface 22 of semicircular housing 20 at opposing locations 39*a* and 39*b* being adjacent to the perimeter edge 30 along the circumference C of semicircular housing 20 (see FIG. 5). In addition, the outer curved surface 22, in an alternate design, includes a hand impression member 40 being formed in the outer curved surface 22 and centrally positioned on the outer curved surface 22 (see FIG. 5) for allowing the user to insert a hand 14 into the hand impression member 40 to provide a better and stronger grip on the exercise ball device 10 when the user's hand 14 is secured by the gripping member 34. The gripping member 34 can be in the form of a grasping sleeve 34*gs*, a hook and loop handle strap 34*hs*, a gripping handle, or other types of gripping restraints.

Figure 2:
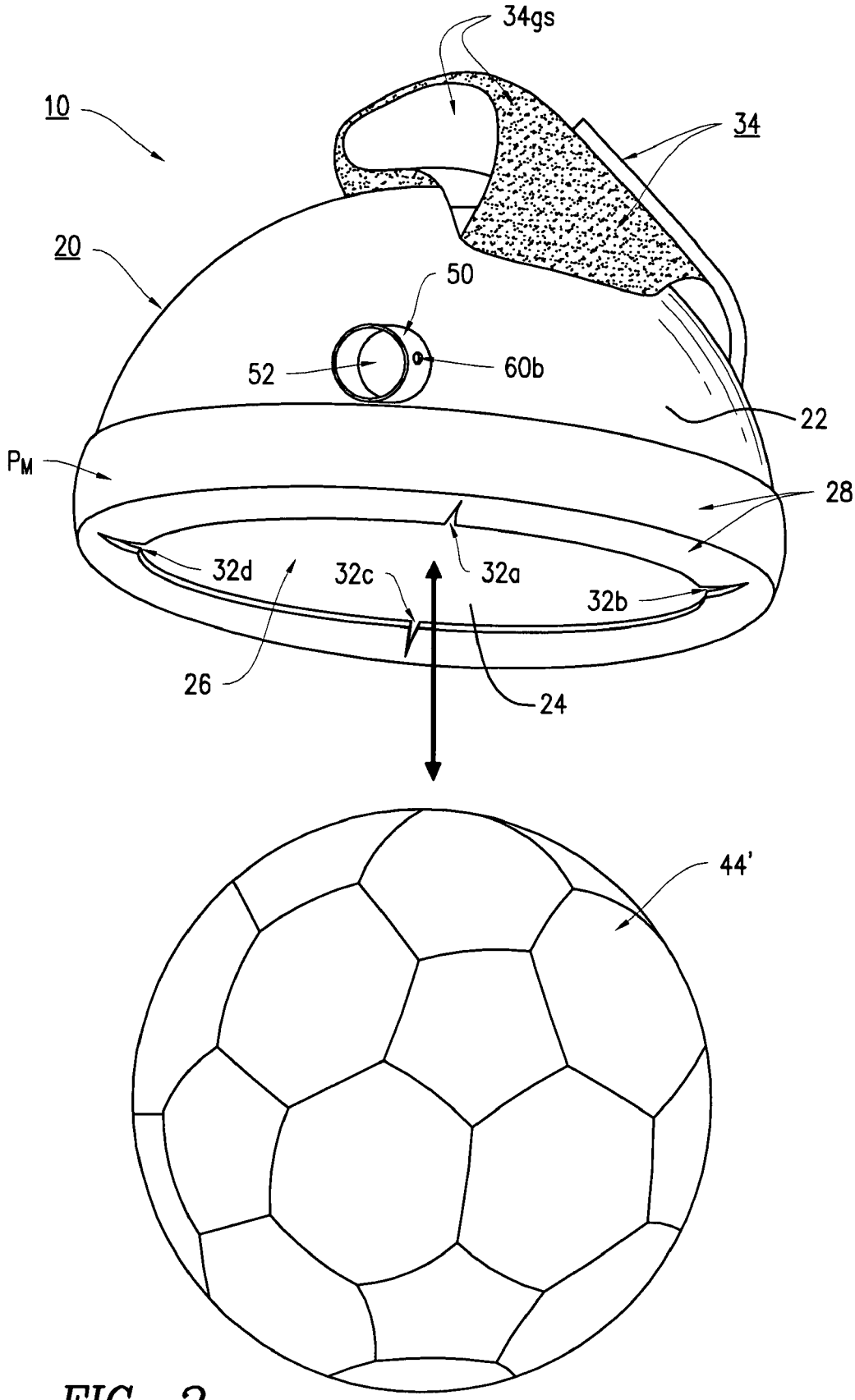
FIG. 2 is an exploded perspective view of the exercise ball device of the present invention showing an outer hemispherical housing or semicircular-shaped housing and a roller ball.
Figure 3:
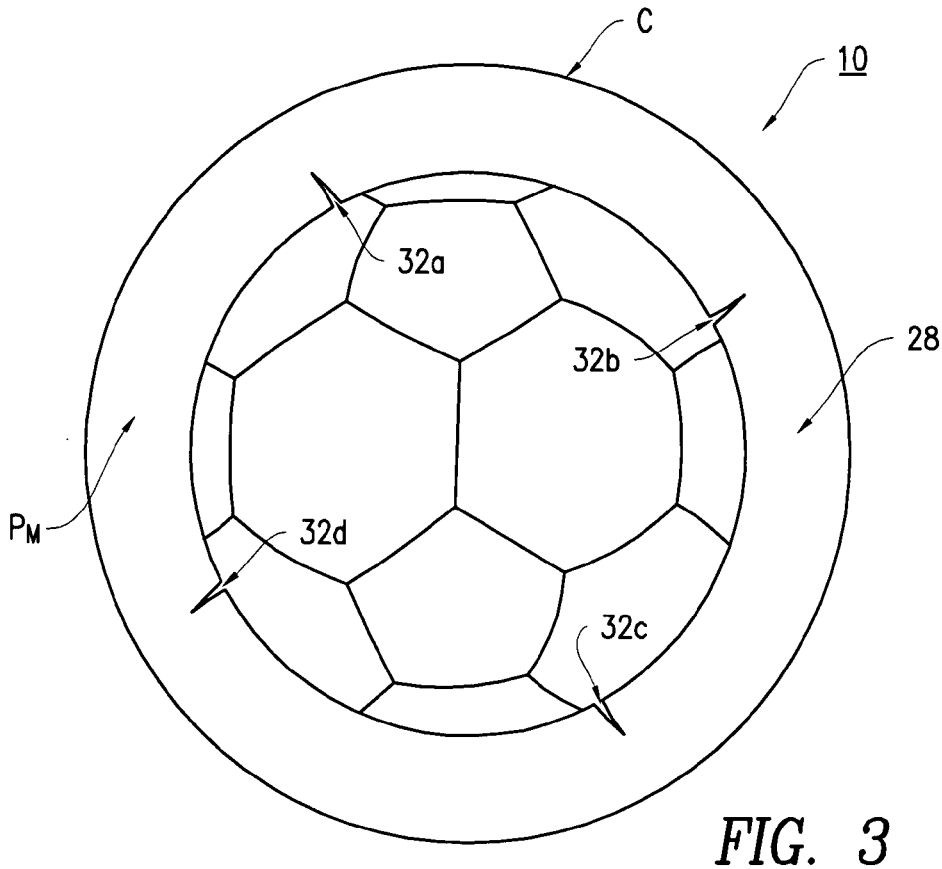
FIG. 3 is a bottom plan view of the exercise ball device of the present invention showing the roller ball and a retaining ring member for holding the roller ball in place.

The inner curved surface 24 of the interior semicircular compartment 26 of semicircular housing 20 includes plurality of spaced-apart inner anti-friction strips 42*a* and 42*b* being fixedly attached to the inner curved surface 24 for allowing ball 44 to roll freely in any direction within the curved compartment 26, as shown in FIG. 4 of the drawings. It is understood that ball 44 within the interior semicircular compartment 26 is removable and replaceable with a different ball 44', as shown in FIG. 2. Further, ball 44 may be refillable by air or is in a solid form S being made from hard plastic or rubber.

Figure 7:
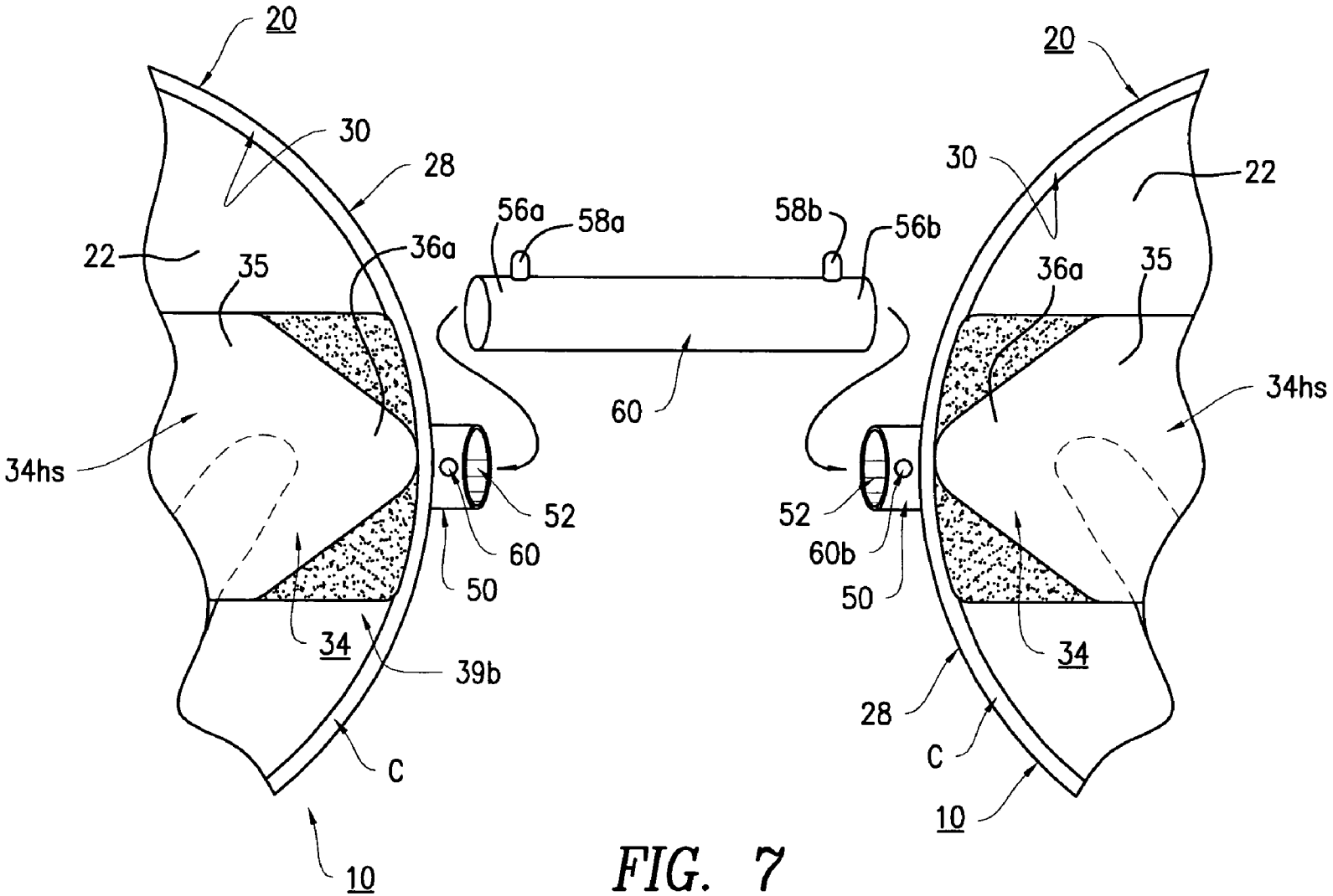
FIG. 7 is a partial top plan view of the exercise ball device of the present invention showing the two semicircular housings being attached with each other by the detachable connecting bar member.

As shown in FIGS. 6 and 7, in an alternate design, the semicircular-shaped housing 20 includes a connector member 50 having a connector opening 52 therein. The connector member 50 is adjacent to the retaining ring member 28 on semicircular housing 20. Two of the connector members 50 are joined together by a detachable connecting bar member 54 in order to form a single unit 60 of the two exercise ball devices 10. Each end 56*a* and 56*b* is inserted within connector openings 52 of connector member 50 and locked in place by locking pins 58*a* and 58*b*, respectively, through locking openings 60*a* and 60*b*.

Figure 8:
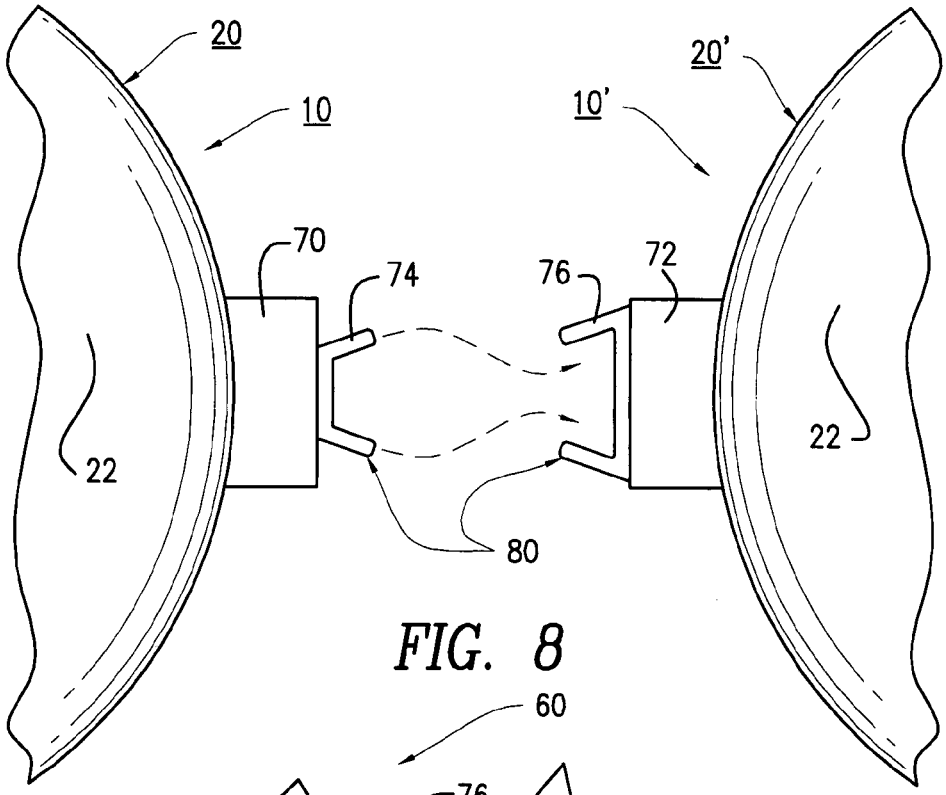
FIG. 8 is a partial top plan view of the exercise ball device of the present invention showing the two semicircular housings being attached with each other by a detachable sliding and interlocking connector member.
Figure 9:
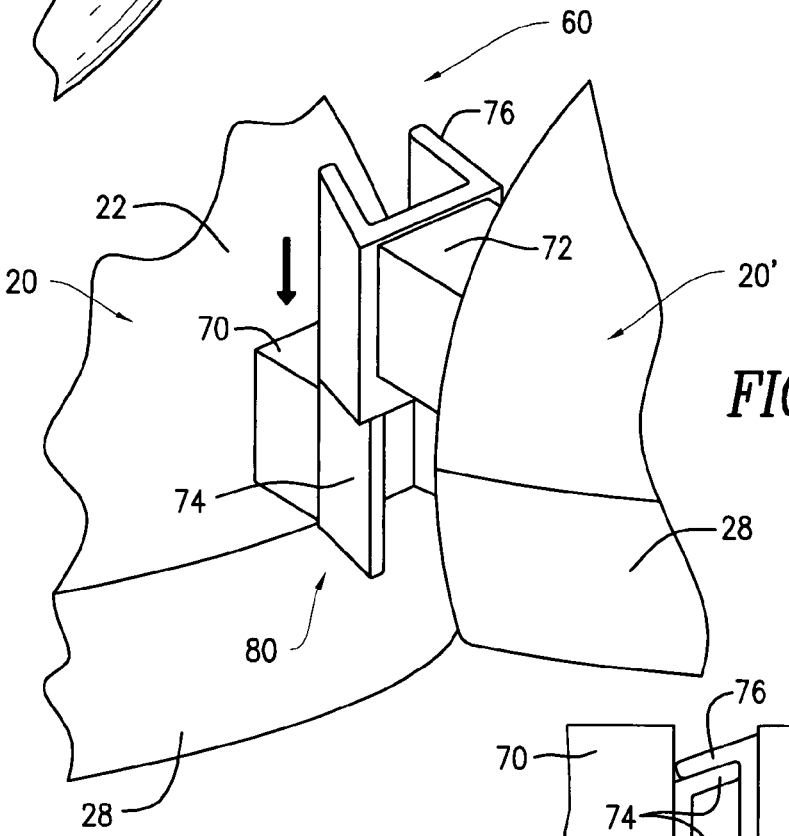
FIG. 9 is a partial perspective view of the exercise ball device of the present invention showing a pair of interlocking elements being slidably connected with each other.
Figure 10:
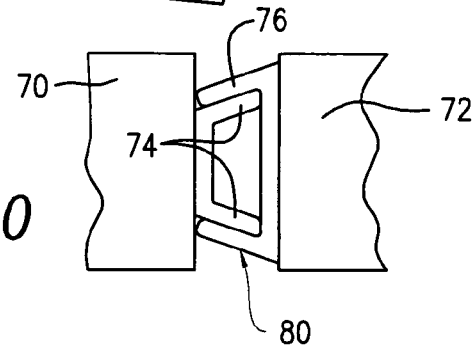
FIG. 10 is a partial top plan view of the exercise ball device of the present invention showing the pair of interlocking elements interlocked with each other.

As depicted in FIGS. 8 to 10, in another alternate design, the semicircular-shaped housing 20 and 20' includes a connector arms 70 and 72 having an interlocking elements 74 or 76, respectively, for forming a connector member 80 for joining each of the housings 20 and 20' together in order to form a single unit 60 of the two exercise ball devices 10 and 10'. Each of the connector arms 70 and 72 are adjacent to the retaining ring member 28 on housings 20 and 20' (see FIG. 9). Interlocking elements 74 and 76 mate and slide relative to each other, as shown in FIGS. 9 and 10 of the patent drawings.

The semicircular-shaped housing 20 can be made of durable hard plastics or lightweight metals such as aluminum. Connector members 50 and the connecting bar member 54 can also be made of durable hard plastics or lightweight metals such as aluminum. Connector member 80 can also be made of pliable, durable plastics or lightweight metals such as aluminum. Connector member 80 can also be made of pliable plastics or lightweight metals such as aluminum.

OPERATION OF THE PRESENT INVENTION

As shown in FIGS. 1, 2, and 5 to 7 of the drawings, the exercise ball device 10 operates in the following manner: The initial step has the user 12 inserting the rolling ball 44 within the interior curved compartment 26, allowing the rolling ball 44 to rotate within and relative to housing 20 (see FIGS. 1 and 2). The rolling ball 44 is removably restrained within the interior curved compartment 26 by the retaining member 28. The anti-friction members 42*a* and 42*b* on the inner curved wall 24 of the interior curved compartment 26 allows the rolling ball 44 to rotate or roll with less friction within the interior curved compartment 26. The exercise ball device 10 is now ready for exercising by the user 12.

In the next step, the user 12 is placing and positioning his or her hand 14 on a first section 35*a* of strap section 35 of holding strap 34*hs* where the user 12 with his or her other hand 14 places the first end 36*a* of a second section 35*b* of strap section 35 through the loop member 37 for looping the hook and loop strap sections 35*a* and 35*b* upon itself, such that the user then tightens the strap section 35 in a manner to immobilize the user's hand 14 on the housing 20 within the holding strap 34*hs*. The user 12 now rolls the exercise ball device 10 on the ground (not shown) while in a prone position for exercising the user's arms, upper torso, legs and calves.

In the alternate design, using two exercise ball devices 10 and 10' together as shown in FIGS. 6 and 7, the user connects each exercise ball device 10 and 10' together to form the single unit 60. In joining each of the exercise ball devices together, the user places and inserts each end 56*a* and 56*b* of connecting bar member 54 within openings 52 of each connector member 50, respectively. The connector bar member 54 is locked in place via locking pins 58*a* and 58*b* through locking openings 60*a* and 60*b*, respectively, as depicted in FIG. 7 of the drawings. The single unit 60 is now ready for operational use. The user now straps each of his or her hands 14 within each holding strap 34*hs*, as previously described. The user begins to now roll the single unit 60 (the two cooperating exercise ball devices 10 working as one) on the ground floor while in a prone position for exercising the user's arms, upper torso, legs, calves and the like. The alternate connector member 80 is ready for operation by the mating of interlocking elements 74 and 76 together, as shown in FIGS. 8, 9 and 10 of the patent drawings.

ADVANTAGES OF THE PRESENT INVENTION

Accordingly, an advantage of the present invention is that it provides for an improved exercise ball device that is simple and easy to operate and exercise with when the user is in a bent over prone position.

Another advantage of the present invention is that it provides for an improved exercise ball device having a semicircular-shaped housing or an outer semicircular housing with a free moving rolling ball within an interior semicircular or curved compartment of the semicircular housing.

Another advantage of the present invention is that it provides for an improved exercise ball device having a restraint member attached to an outer curved surface of the semicircular housing for holding the exercise ball device when in an operational mode, wherein the restraint member can be in the form of a grasping sleeve, a Velcro™ holding strap, a gripping handle, other gripping restraints and the like.

Another advantage of the present invention is that it provides for an improved exercise ball device having a restraint member in conjunction with a hand impression member positioned also on the outer curved surface of the semicircular housing for allowing the user a better and stronger grip on the exercise ball device when the user's hands are secured by the restraint members.

Another advantage of the present invention is that it provides for an improved exercise ball device where the roller ball in the interior curved compartment of the outer semicircular housing is removable and replaceable and the rolling ball is refillable by air or is in a solid form such as a hard plastic, rubber and the like.

Another advantage of the present invention is that it provides for an improved exercise ball device that includes inner anti-friction sections or strips attached to an inner curved surface of the interior curved compartment of the semicircular housing permitting the rolling ball to roll freely in any direction within the interior curved compartment.

Another advantage of the present invention is that it provides for an improved exercise ball device that is compact in size for easy storage, lightweight for maneuverability, uncomplicated in structure and easily used and operated by the user during his or her workout.

A further advantage of the present invention is that it provides for an improved exercise ball device that can be mass-produced in an automated and economical manner and is readily affordable by the consumer.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An exercise ball device for exercising by a user while in a prone position, comprising:

a) a semi-circular shaped housing having an outer curved surface and an interior curved compartment having an inner curved surface; wherein the central vertical axis of said outer curved surface and the central vertical axis of said inner curved surface define a common vertical axis;

b) said housing having a retaining member positioned on the perimeter edge of said housing;

c) a rolling ball positioned within said interior curved compartment, said rolling ball being removably restrained within said interior curved compartment by said retaining member; wherein said rolling ball has a central vertical axis which is located on said common vertical axis of said inner and outer curved surfaces; and d) said outer curved surface of said housing having a restraint member attached thereto for receiving the hand of a user.

2. An exercise ball device in accordance with claim 1, wherein said rolling ball is approximately the same size as said interior curved compartment so that said rolling ball rotates within and relative to said housing.

3. An exercise ball device in accordance with claim 1, wherein said retaining member includes flexible retaining sections for inserting or removing said rolling ball from said interior curved compartment of said housing.

4. An exercise ball device in accordance with claim 1, wherein said retaining member is made from flexible material selected from the group consisting of neoprene, polyester, styrofoam, rubber, nylon, teflon and combinations thereof.

5. An exercise ball device in accordance with claim 1, wherein said outer curved surface of said housing includes a hand impression formed in said outer curved surface for allowing the user to insert a hand into said hand impression to provide a stronger grip on said exercise ball device while the user's hand is secured by said restraint member.

6. An exercise ball device in accordance with claim 1, wherein said restraint member is selected from the group consisting of a grasping member, a hook and loop strap, a gripping handle and other gripping restraints.

7. An exercise ball device in accordance with claim 1, wherein said inner curved surface of said interior curved compartment includes a plurality of anti-friction members being attached to said inner curved surface for allowing said rolling ball to rotate with less friction within said interior curved compartment.

8. An exercise ball device in accordance with claim 1, wherein said rolling ball in said interior curved compartment is removable and replaceable with a different rolling ball.

9. An exercise ball device in accordance with claim 1, wherein said rolling ball is refillable by air or is in a solid form such as hard plastic or rubber.

10. An exercise ball device in accordance with claim 1, wherein said housing includes a connector member for connection to another exercise ball device.

11. An exercise ball device in accordance with claim 10, wherein two of said connector members are joined together by a detachable connecting members to join two of said exercise ball devices.

12. An exercise ball device in accordance with claim 11, wherein said detachable connecting member is up to six inches in length for spacing apart two of said connected exercise ball devices for allowing the user to place his or her two hands on said two connected exercise ball devices.

13. An exercise ball device in accordance with claim 1, wherein said restraint member is attached to said outer curved surface by attachment means connected to opposite sides of said perimeter edge.

14. An exercise ball device in accordance with claim 13, wherein said attachment means are bolts, rivets, machine screws and other attachment members.

* * * * *